US006878868B2

(12) United States Patent
McMillan

(10) Patent No.: US 6,878,868 B2
(45) Date of Patent: Apr. 12, 2005

(54) PORTABLE HIGH-HAT DEVICE

(76) Inventor: Stacy L. McMillan, 1718 Lindsley Park Dr., San Marcos, CA (US) 92069

( * ) Notice: Subject to any disclaimer, the term of this patent is extended or adjusted under 35 U.S.C. 154(b) by 94 days.

(21) Appl. No.: 10/603,457

(22) Filed: Jun. 24, 2003

(65) Prior Publication Data

US 2004/0261604 A1 Dec. 30, 2004

(51) Int. Cl.[7] ..... G10D 13/02

(52) U.S. Cl. ..... 84/422.3; 84/422.1; 84/422.2; 84/411 R

(58) Field of Search ..... 84/422.3, 422.2, 84/422.1, 411 R

(56) References Cited

U.S. PATENT DOCUMENTS 5,367,939 A * 11/1994 Barker ..... 84/402
5,438,903 A * 8/1995 Cropek ..... 84/422.3
2004/0103775 A1 * 6/2004 Vergara ..... 84/422.3

* cited by examiner

*Primary Examiner*—Shih-yung Hsieh
(74) *Attorney, Agent, or Firm*—Gordon & Rees LLP

(57) ABSTRACT

A combination of a portable high-hat cymbal device and a drum including a drum cylinder-terminated at least on one end by a circular rim and having a drum head stretched thereover to create a drum noise when struck by a drum stick operated by a drummer, first and second cymbals held in opposed formation near the rim of the drum and within reach of the drumsticks held in the hands of the drummer, the cymbals centrally supported on a vertical spindle attached to the drum, with the first cymbal in fixed location above the second cymbal, an abutment, supporting the second cymbal in biased contact with the first cymbal, and slidingly received on the vertical spindle, and pivotal arm, spaced apart from the spindle and operable by motion of the drummer's arm, to move the second cymbal downward on the spindle, against the bias pressure, so that, upon release by the drummer of the first means, the bias pressure moves the second cymbal abruptly upward to crash against the first cymbal to make the appropriate high-hat sound.

20 Claims, 4 Drawing Sheets

PORTABLE HIGH-HAT DEVICE

BACKGROUND OF THE INVENTION

1. Field of the Invention

This invention pertains to musical instruments. More particularly the invention pertains to the field of percussion instruments and to a unique "hi-hat" arrangement of cymbals on a drum operative during marching and useful in other musical activities.

2. Description of the Prior Art

While many musical instruments may be operated where the musician is in the standing or sitting position or while marching, such as violins, saxophone, trumpets, and the like, certain percussion instruments are not capable such operation. The common percussion drum is playable while marching when it is strapped to the drummer and the drum head is located in front of him or her. A cymbal is also playable while marching when it is mounted on an arm attached to the marcher's drum. However, the common "hi-hat" set of cymbals has only been playable when located on the floor next to the drummer who is seated during its use.

The use of a hi-hat set of cymbals is often desired in marching and other music however its transition to a marching drum has not been successful. In operation of a hi-hat device, a pair of cymbals is mounted, rim-to-rim or in facing arrangement, on a vertical or near-vertical spindle and a floor mounted device is operated by the drummer's foot to move them apart a short distance and then abruptly bring them together to create a "crash" sound that is desired in many musical tunes. U.S. Pat. No. 5,438,903 is a good example of a hi-hat device that is operated by a foot pedal.

There is good reason for utilizing the drummer's foot in making the hi-hat operate and that is that the drummer's hands are busy with the drum sticks beating on the drum and/or the cymbals and are not available for use on the hi-hat This would appear to also prevent a hi-hat from being used in a marching environment because the drummer's feet are used to march and have no time to operate the hi-hat. Even if the hi-hat were to be mounted on the drum, its use would be confined to one hand of the drummer, such as shown in U.S. Pat. No. 792,080. This use takes away from the drummer the use of both hands to beat the drum.

SUMMARY OF THE INVENTION

This invention is a combination of a portable high-hat cymbal and a marching drum, or a high-hat useful in non-marching activities, where the cymbals are held in opposed formation near the rim of the drum, opposite the drummer, centrally supported on a vertical spindle attached to the drum. A pivotal arm, spaced-apart from the cymbals and mounted on the drum nearer to the drummer is operable by motion of the drummer's forearm, to move the second cymbal downward on the spindle, against bias pressure, so that, upon release of the arm, the bias pressure moves the second cymbal abruptly upward to crash against the first cymbal to make the appropriate high-hat sound. In other venues, the invention may be used where the drummer is sitting and his or her feet are busy tapping on other instruments, such as a base drum, other cymbals, etc.

Accordingly, the main object of this invention is a drum-mounted hi-hat cymbal combination operable by the marching or sitting drummer with his or her forearm thus leaving both feet and hands free to march and play other instruments such as and beating another drum. Other objects of the invention include a means to utilize the hi-hat percussion instrument in venues not heretofore allowed with complete freedom given to both hands and feet of the user.

These and other objects of the invention will become more clear when one reads the following specification, taken together with the drawings that are attached hereto. The scope of protection sought by the inventor may be gleaned from a fair reading of the Claims that conclude this specification.

DESCRIPTION OF THE PREFERRED EMBODIMENT

Figure 1:
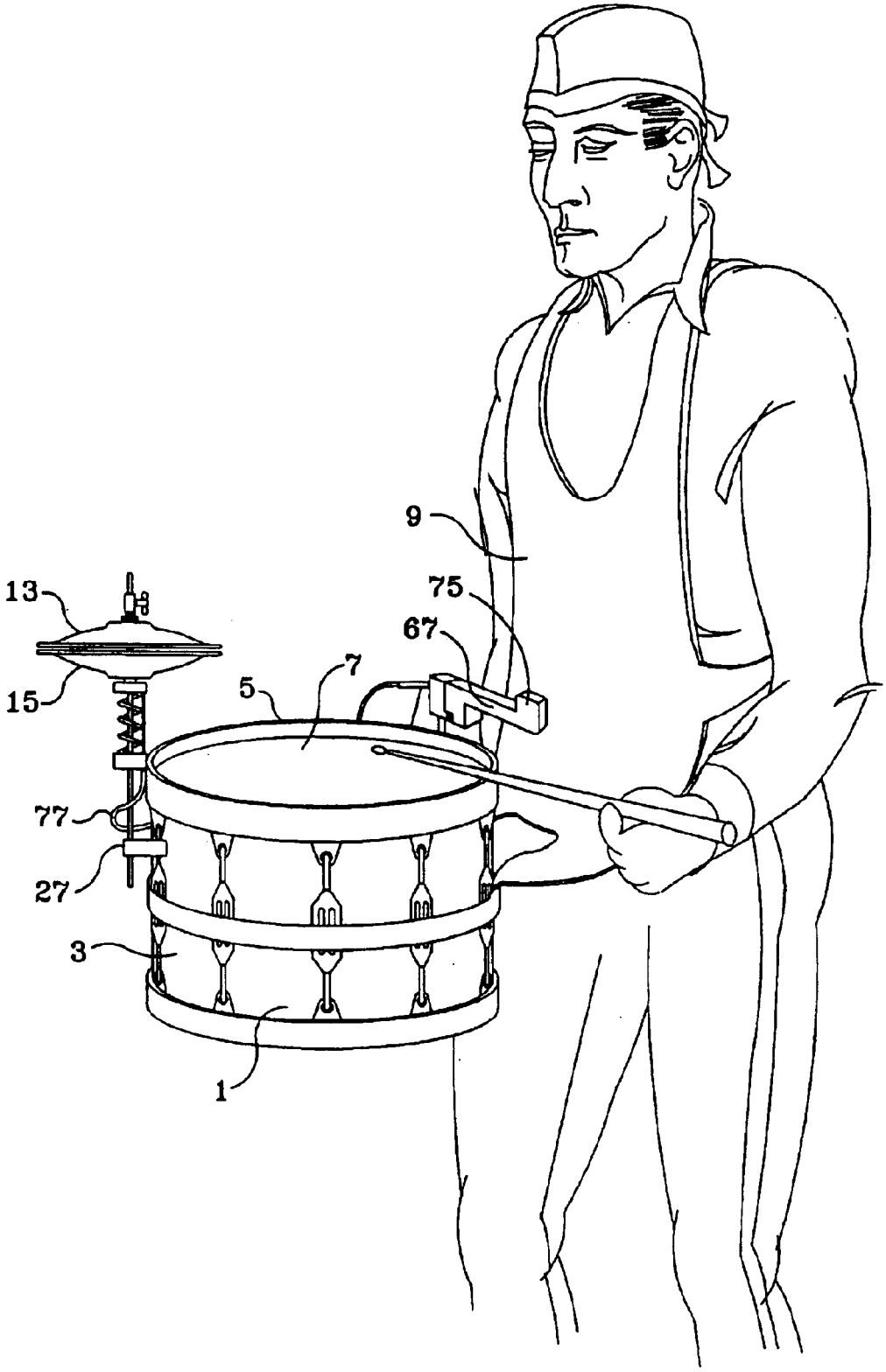
FIG. 1 is an illustrative view of the combination of the portable hi-hat device mounted on a drum worn by a drummer.

Turning now to the drawings, wherein elements are identified by numbers and like elements are identified by like numbers throughout the five figures, FIG. 1 shows a combination of a portable high-hat cymbal device and a marching drum. A drum 1 is shown that includes a drum cylinder 3, preferably arranged vertically, and terminated at least on the top end by a circular rim 5 and having a drum head 7 stretched thereover to create a drum noise when struck by one or more drum sticks (not fully shown) operated by a drummer (not completely shown). Drum 1 is usually attached to the marching drummer by a sling 9 passed around the waist and over the shoulders of the drummer to mount the drum in front of the drummer during marching. In other activities, drum 1 is often set on the floor in front of the drummer, held between the drummer's knees, or mounted in a low mount in front of the drummer.

Figure 2:
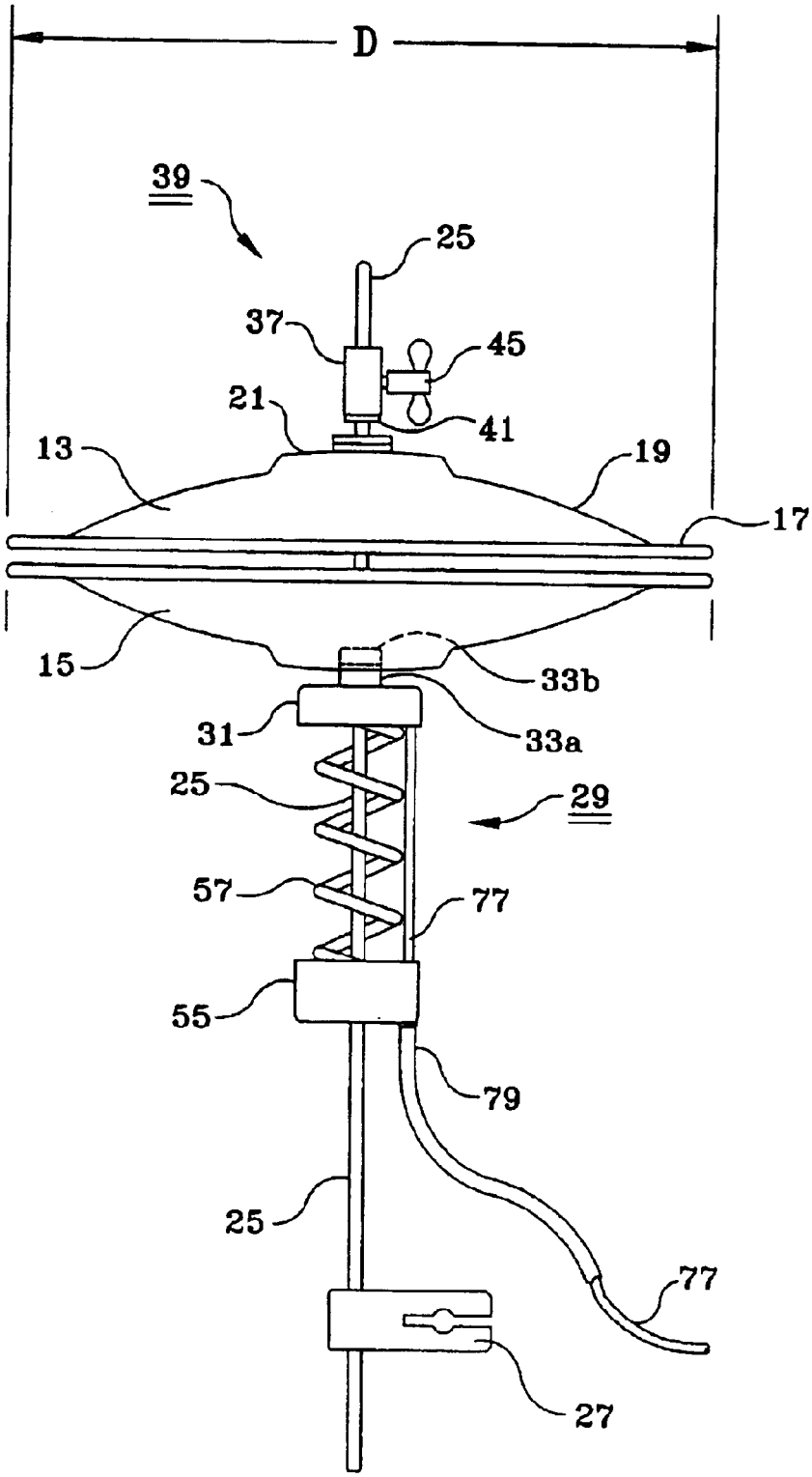
FIG. 2 is a side close-up view of the preferred embodiment of the hi-hat operative mechanism of this invention.

First and second cymbals, 13 and 15 respectively, are shown held in opposed, faced-together, "hi-hat"formation near rim 5 of drum 1. As shown in FIG. 2, cymbals 13 and 15 each are preferably of the same outside diameter "D". Each cymbal includes a generally flat annular circumference 17 leading inward through a sloping intermediate portion 19 to a flat, recessed and holed circular center area 21. Cymbals 13 and 15 are shown in FIG. 2 to be mounted in facing arrangement with their flat annular circumferences 17 closest to each other. Both cymbals 13 and 15 are centrally supported on a spindle 25, with first cymbal 13 in fixed attachment to spindle 25, above second cymbal 15. Spindle 25 is preferably in vertical orientation with respect to the plane of drum circular rim 5 and is attached at its lower end to drum rim 5 by a clamp 27. It is preferred to mount the hi-hat near the drummer so that it can be struck with the drum sticks held in the hands of the drummer as well as brought together in a crashing noise. A first means 29 is provided, as hereinafter more fully explained, to move second cymbal 15 downward on spindle 25 and then sharply or quickly raise it to "crash" against first cymbal 13 to create the well-known hi-hat sound.

Figure 4:
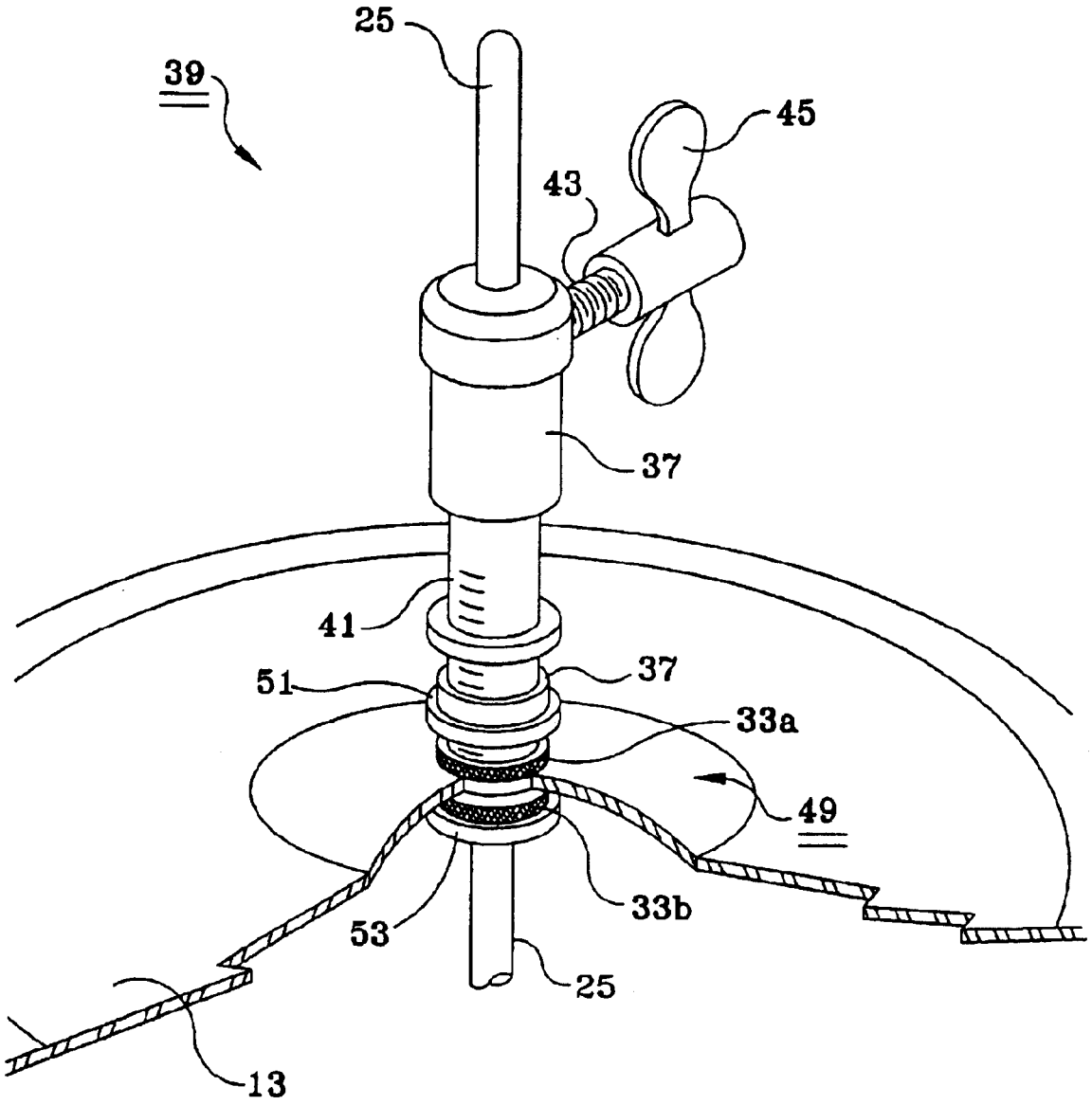

As shown in FIG. 2, first means 29 includes a first collar 31, slidingly received on spindle 25, that acts as an abutment for supporting second cymbal 15 in biased contact under first cymbal 13. Preferably, cymbal 15 is sandwiched between a pair of small diameter felt washers 33*a* and 33*b* that are placed one on each side of cymbal 15 and centered thereon. As shown in FIG. 4, a cylindrical member or sleeve 37 is provided, having an inside diameter sufficient to allow passage therethrough of vertical spindle 25. A second means 39, for clamping sleeve 37 to vertical spindle 25, is mounted on sleeve 37. A preferred form of means 39 is shown in FIG. 4 to include a cylindrical shackle 41 attached in threaded engagement to sleeve 37 and a cross-screw 43, extending into sleeve 37 through an aperture formed in shackle 41, and advanceable toward spindle 25 by twisting a butterfly handle 45 attached to screw 43.

A third means 49 is provided for receiving a similar pair of felt washers 33*a* and 33*b* in centralized location on spindle 25 to aid in clamping first cymbal 13 therebetween. As shown in FIG. 4, third means 49 includes a top ring 51, threadably engaged on the outside of sleeve 37, above felt washer 33*a* and first cymbal 13, and a bottom ring 53, threadably engaged likewise on the outside of sleeve 37 below felt washer 33*b*. Top ring 51 and bottom ring 53 are twisted in opposite directions to tighten them against felt washers 33*a* and 33*b* and against first cymbal 13 to hold cymbal 13 tightly therebetween.

As shown in FIG. 2, a second collar 55 is provided, spaced below first collar 31 and is fixedly attached to vertical spindle 25. A bias means, such as a slightly compressed cylindrically wound spring 57, of an inside diameter sufficient to fit over vertical spindle 25 and abut said first collar 31 and second collar. Spring 57 is located in contact with first and second collars 31 and 55, to provide bias pressure between collars 31 and 55 to force second cymbal 15 upward on spindle 25 and against first cymbal 13.

Figure 3:
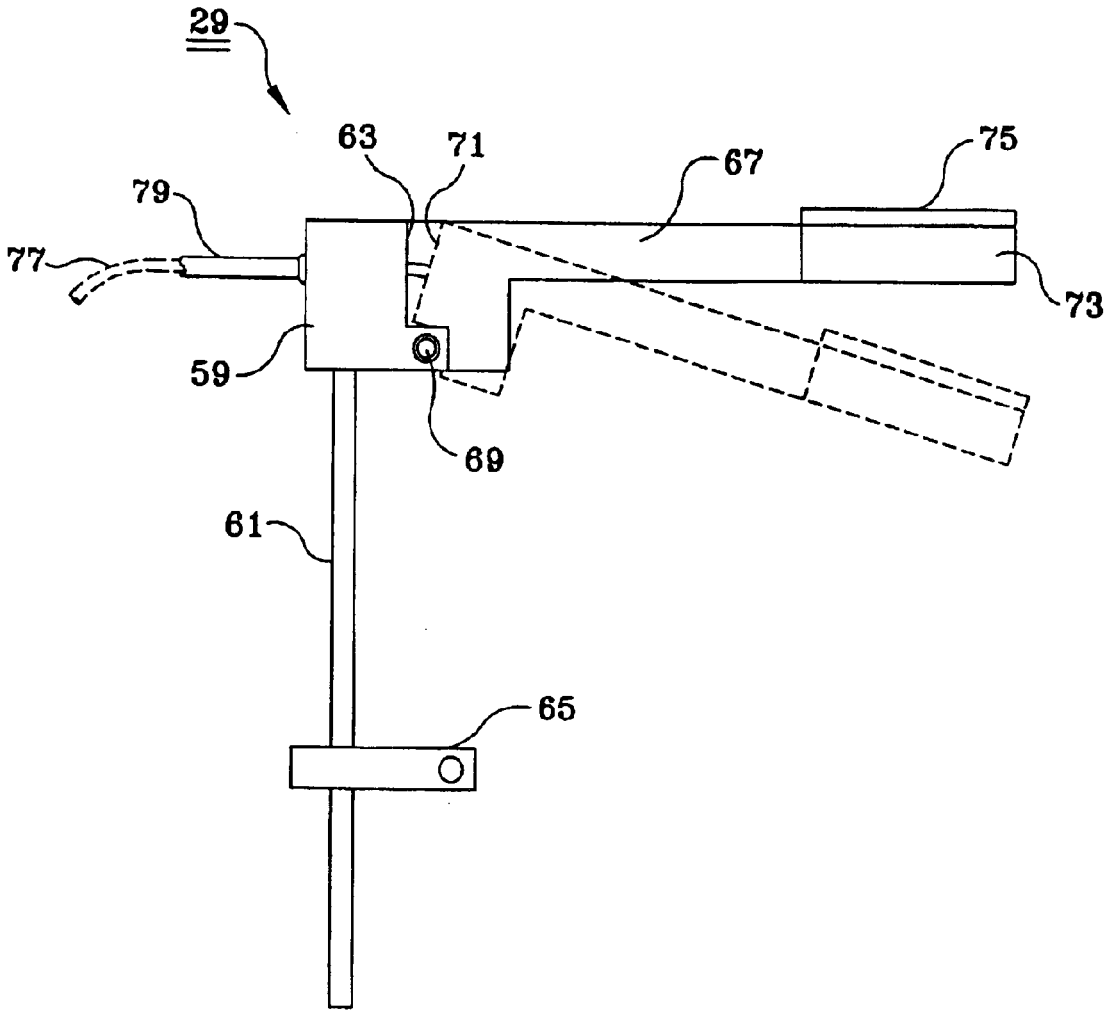
FIG. 3 is a closer side elevation view of the preferred embodiment of the means to operate the hi-hat of this invention.
Figure 3A:
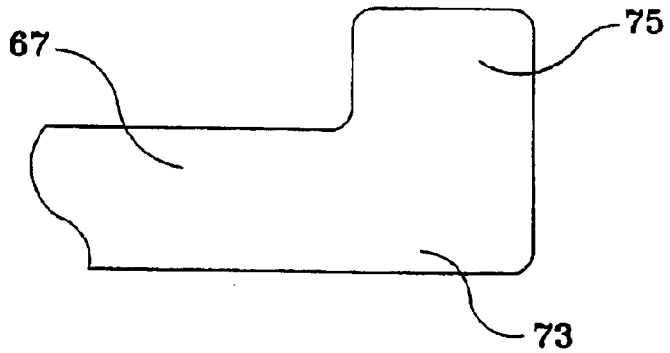
FIG. 3*a* is a close-up view of the end of the action arm that is struck by the drummer to work the hi-hat; and, FIG. 4 is a close-up view of the manner of mounting the top or first hi-hat cymbal on the hi-hat device.

As shown in FIG. 3, first means 29 also includes a block 59, having a mounting rod 61 extending downward therefrom, for mounting to drum 1, such as by a clamp 65, and preferably mounted close to drum 1 in spaced-apart relation from first collar 31. First means 29 is therefore partially located on spindle 25 and partially located apart from spindle 25. An arm 67 is pivotally mounted at 69 to block 59, or with respect to said block 59, and includes a second contact surface 71 that is adapted to move toward and away from first contact surface 63 during pivotal movement of arm 67 as shown in dotted outline. First contact surface 63 and second contact surface 71 are normally biased into full contact by spring 57 when arm 67 is at rest. Arm 67 further includes a portion 73 that extends upward from its pivotal mounting and forms, as shown in FIG. 3*a*, a surface 75 adapted to be contacted by the forearm of the drummer while he or she uses their hands to operate the drum sticks in normal drumming activity. A cable 77, is stretched between first collar 31 and arm 67 for providing parting movement of first and second contact surfaces when arm 67 is moved by the drummer's forearm. Preferably, cable 77 is covered by a sheath 79 whose ends are anchored respectively in second collar 55 and block 59 so that cable 77 can draw first collar 31 downwardly toward second collar 55 and into sheath 79 while arm 67 can pull cable 77 from the bottom surface of collar 31 and out of sheath 79, and the cymbals drawn apart.

In operation, when the drummer's forearm is brought against surface 75, arm 67 overcomes the bias of spring 57 and pivots second contact surface 71 away from first contact surface 63 to cause said first and second cymbals 13 and 15 to move apart on spindle 25. When the drummer releases his or her pressure against arm 67, spring 57 forces arm 67 to rebound to its original position and allows first and second contact surfaces 63 and 71 to move together and allows cable 77, passing between arm 67 and block 59 to transmit the pivotal movement of arm 67 to vertical movement of first collar 33 and allowing the cymbals to crash together.

While the invention has been described with reference to a particular embodiment, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A portable high-hat cymbal device, for operation with a drum comprising:

a) first and second cymbals held in opposed formation near the rim of the drum, said cymbals centrally supported on a vertical spindle with said first cymbal in fixed location above said second cymbal;

b) a first collar, slidingly received on said vertical spindle, supporting said second cymbal in biased contact with said first cymbal; and, c) a first means, partially spaced-apart from said spindle and operable by motion of an arm of the drummer, to move said second cymbal downward on said spindle, against said bias pressure, so that, upon release of said pressure by the drummer's arm, said bias pressure moves said second cymbal abruptly upward to crash against said first cymbal to make the appropriate high-hat sound.

2. The portable high-hat cymbal device of claim 1 where each said first and second cymbals are of the same outside diameter.

3. The portable high-hat cymbal device of claim 1 where each said first and second cymbals are of the same outside diameter, have a generally flat annular rim portion leading inward through a sloping intermediate portion to a flat, recessed circular center portion and are in facing arrangement with their flat annular rims closest to each other.

4. The portable high-hat cymbal device of claim 1 where said first cymbal is fixed tightly to said vertical spindle.

5. The portable high-hat cymbal device of claim 4 where said first cymbal is centrally supported on said vertical spindle and sandwiched between a pair of felt washers.

6. The portable high-hat cymbal device of claim 5 further including:

a) a cylindrical member having an inside diameter sufficient to allow passage therethrough of said vertical spindle;

b) second means for clamping said second cylindrical member in slidable arrangement to said vertical spindle; and, c) third means, received on the outside of said vertical spindle, for receiving a pair of felt washers in centralized location thereon to aid in clamping said second cymbal therebetween.

7. The portable high-hat cymbal device of claim 1 wherein said first means, for supporting said second cymbal in biased contact with said first cymbal, comprises:

a) a first collar, for slidingly supporting said second cymbal on said vertical spindle;

b) a second collar, spaced below said first collar and in fixed connection with said vertical spindle; and, c) a spring located between said first and said second collar to hold said first collar in biased position above said second collar.

8. The portable high-hat cymbal device of claim 7 wherein said spring is a cylindrically wound spring of an inside diameter sufficient to fit over said vertical spindle and abut said first and said second collars.

9. The portable high-hat cymbal device of claim 1 wherein said first means, to move said second cymbal downward on said spindle, comprises:

a) a block including a first contact surface;

b) an arm, pivotally mounted with respect to said block, and including a second contact surface adapted to move toward and away from said first contact surface during pivotal movement of said arm with respect to said block;

c) said arm further including a portion extending from said pivotal mounting adapted for contact and movement by the drummer to cause said first and second cymbals to move apart; and, d) a cable passing between said arm and said block to transmit pivotal movement of said arm to vertical movement of said first collar second cymbal.

10. The portable high-hat cymbal device of claim 9 wherein said cable is sheathed.

11. The portable high-hat cymbal device of claim 10 wherein said sheath is terminally mounted in said block and said second collar.

12. A combination of a portable high-hat cymbal device and a marching drum comprising:

a) drum including a drum cylinder terminated at least on one end by a circular rim and having a drum head stretched thereover to create a drum noise when struck by a drum stick operated by a drummer;

b) first and second cymbals held in opposed formation near said rim of said drum and sufficiently close to the drummer for contact by drumsticks held in the hands of the drummer, said cymbals centrally supported on a vertical spindle attached to said drum, with said first cymbal in fixed location above said second cymbal;

c) a collar, supporting said second cymbal in biased contact with said first cymbal, and slidingly received on said vertical spindle; and, d) first means, spaced apart from said spindle and operable by motion of an arm of the drummer, to move said second cymbal downward on said spindle, against said bias pressure, so that, upon release by the drummer of said-first means, said bias pressure moves said second cymbal abruptly upward to crash against said first cymbal to make the appropriate high-hat sound.

13. The combination of a portable high-hat cymbal device and marching drum of claim 12 where each said first and second cymbals are of the same outside diameter, have a generally flat annular rim portion leading inward through a sloping intermediate portion to a flat, recessed circular center portion and are in facing arrangement with their flat annular rims closest to each other.

14. The combination of a portable high-hat cymbal device and marching drum of claim 12 where said first cymbal is fixed tightly to said vertical spindle.

15. The combination of a portable high-hat cymbal device and marching drum of claim 12 where said first cymbal is centrally supported on said vertical spindle and sandwiched between a pair of felt washers.

16. The combination of a portable high-hat cymbal device and marching drum of claim 15 further including:

a) a cylindrical member having an inside diameter sufficient to allow passage therethrough of said vertical spindle;

b) second means for clamping said second cylindrical member in slidable arrangement to said vertical spindle; and, c) third means, received on the outside of said vertical spindle, for receiving a pair of felt washers in centralized location thereon to aid in clamping said second cymbal therebetween.

17. The combination of a portable high-hat cymbal device and marching drum of claim 12 wherein said abutment, for supporting said second cymbal in biased contact with said first cymbal, comprises:

a) a first collar, for slidingly supporting said second cymbal on said vertical spindle;

b) a second collar, spaced below said first collar and in fixed connection with said vertical spindle; and, c) a spring located between said first and said second collar to hold said first collar in biased position above said second collar.

18. The combination of a portable high-hat cymbal device and marching drum of claim 17 wherein said spring is a cylindrically wound spring of an inside diameter sufficient to fit over said vertical spindle and abut said first and said second collars.

19. The combination of a portable high-hat cymbal device and marching drum of claim 12 wherein said first means, to move said second cymbal downward on said spindle, comprises:

a) a block mounted to said drum and including a first contact surface;

b) an arm, pivotally mounted with respect to said block, and including a second contact surface adapted to move toward and away from said first contact surface during pivotal movement of said arm with respect to said block;

c) said arm further including a portion extending from said pivotal mounting adapted for contact and movement by the drummer to cause said first and second cymbals to move apart; and, d) a cable passing between said arm and said block to transmit pivotal movement of said arm to vertical movement of said first collar second cymbal.

20. The portable high-hat cymbal device of claim 19 wherein said cable is sheathed.

* * * * *